United States Patent [19]

Monson

[11] 4,060,188

[45] Nov. 29, 1977

[54] IMPACT NAILING ARRANGEMENT

[75] Inventor: Franklin A. Monson, Glen Arm, Md.

[73] Assignee: AAI Corporation, Cockeysville, Md.

[21] Appl. No.: 476,010

[22] Filed: June 3, 1974

Related U.S. Application Data

[63] Continuation-in-part of Ser. No. 367,063, June 4, 1973, abandoned.

[51] Int. Cl.[2] ..... B25C 1/12

[52] U.S. Cl. ..... 227/9

[58] Field of Search ..... 227/8, 9, 10

[56] References Cited

U.S. PATENT DOCUMENTS

| | | | |
|---|---|---|---|
| 1,365,869 | 1/1921 | Temple | 227/9 |
| 1,984,117 | 12/1934 | Davis | 227/8 |
| 2,166,041 | 7/1939 | Cox | 227/9 |
| 3,497,124 | 2/1970 | Temple et al. | 227/10 |
| 3,565,312 | 2/1971 | Temple | 227/9 |

*Primary Examiner*—Granville Y. Custer, Jr.
*Attorney, Agent, or Firm*—Reginald F. Pippin, Jr.

[57] ABSTRACT

An impact nailing arrangement having a nail with integral pointed target-penetration and securing forward section, rear hammer section, and medial compression shear section, the forward section having a threaded object-securing surface rearwardly of its pointed forward target-securing end. The nail is propelled into a target by a percussion-ignited propellant charge, and the forward section is secured by initial point penetration and subsequent compression shear of the medial shear section to enable the hammer section to impart a secondary securing impact to the forward section.

13 Claims, 8 Drawing Figures

INVENTOR
FRANKLIN A. MONSON

ATTORNEY

INVENTOR

FRANKLIN A. MONSON

BY

ATTORNEY

IMPACT NAILING ARRANGEMENT

This application is a continuation in part of my copending application Ser. No. 367,063, filed June 4, 1973, now abandoned.

This invention relates to nailing arrangements, and more particularly to impact nailing arrangements which may be utilized to effect securing of an object to a target piece which may be formed of high-strength relatively low-elasticity steel or the like.

Hand-held nailers or staplers have heretofore been made for attaching a metal sheet or other object, such as a bracket, to a target in the form of a steel plate, such conventionally incorporating a high-strength steel nail or stud stapled or nailed to the target and utilized as a bolt or tension member to fasten metal sheets, brackets, or other items to the target. A primary problem associated with this type of connection is the fastening or retention of the nail or stud to the target. This has been accomplished by the partial penetration or embedment of a knurled tapered point end on the nail or stud into the target material, utilizing a hand-held holder and propellant powder for imparting nail or stud penetration. Typical nail or stud firing velocities of 750 to 800 feet per second have been utilized with hand-held nailing or stapling arrangements. At this velocity, the nail or stud may penetrate the target sheet to a depth of 0.4 inches, which is sufficient depth to embed the point and knurled surface thereon into a target sheet or relatively low-strength, high-elasticity steel, and thereby achieve a nominally satifactory structural joint between the nail or stud and the target sheet. In this respect, the nail or stud is retained in the target material of this type due to the ability of the elastic target material to deflect in a radial direction during nail or stud penetration and then to elastically flow back over the nail or stud knurl, thereby entrapping the nail or stud in the target sheet. The target material entrapping the knurled point nail or stud with the target provides a nail or stud retention which will resist tension pull-out loads of a sometimes acceptable order of magnitude, as for instance up to 2200 pounds. However, with the prior art arrangements of this type, such have been found to be useful only in low-strength steel target plates of up to 1 inch thickness, as above this thickness the rebound energy of the nail or stud is of such a magnitude that it exceeds the transient gripping forces during penetration and rebound, and results in the nail or stud bouncing out of the hole or its being loose in the target material, with relatively low and ineffective joint strength.

This prior art nailing or stapling arrangement and method depends on the elasticity of the steel target material in order to achieve intimate material contact between the knurls of the nail element and the hole surface of the target material. It is also dependent on the area of this contact in order to provide a joint of effective structural quality. Among the disadvantages inherent in this prior art method of nailing or stapling, in addition to those noted above, are that the knurled nail or stud point used for joint connection is inherently an inefficient penetrator which must be of sufficient size and driven to a sufficient depth in the steel target so as to insure the knurls of the nail or stud are effectively engaged by the target material.

To attempt to drive this inefficient configuration into a steel target requires a high level of energy to achieve the necessary nail or stud velocity. To increase the capability of this prior art device so as to afford greater nail or stud holding power with a given target material, or with respect to its use against targets or thicker steels and/or higher strength steels, would require even higher levels of energy, which levels of energy would produce excessive recoil loads for hand-held operation, which is a particularly desirable form of operation in some instances such as in underwater use. In addition, such higher levels of energy being imparted to the nail or stud impose stringent design criteria on the nail or stud firing device and produce high structural loads on the nail or stud during penetration, which high structural loads may cause unpredicatable degradation of the nail or stud. In addition, in utilizing this prior art arrangement the steel target material must be sufficiently elastic to properly engage the knurls of the nail or stud penetrating section, and this condition precludes its use for nailing to higher strength but less elastic steels, as the strength of the joint is relatively low in such instances, if the joint is effective at all, as the joint strength is basically determined by the small amount of target material which entraps the nail or stud knurl. Further, this prior art arrangement provides essentially little or no capability for fastening to steel target plates of 1 inch or thicker, even with relatively low-strength more elastic steels.

It is an object and feature of this invention to effect a substantial improvement in nailing arrangements, and particularly arrangements which may be hand-held in order to achieve higher strength joints in relatively high-strength steels, independent of thickness, with energy requirements compatible with hand-held operation.

It is a further feature to provide an improved nailing arrangement which utilizes a smooth pointed penetrator which serves as the joint connection, without the requirement for knurls or the like at the zone of joint connection between the target and the nail or stud, and in which the nail or stud may be effectively secured to target materials of high-strength low-elasticity steels and/or steels of infinite thickness.

Still a further feature is the provision of a nailing or stapling arrangement and staple or nail which enables the imparting of a self-operated secondary impact for improved fastening to a target.

Still other objects, features and attendant advantages will become apparent to one skilled in the art from a reading of the following detailed description of a preferred embodiment constructed in accordance with the invention, taken in conjunction with the following drawings wherein.

Figure 5:
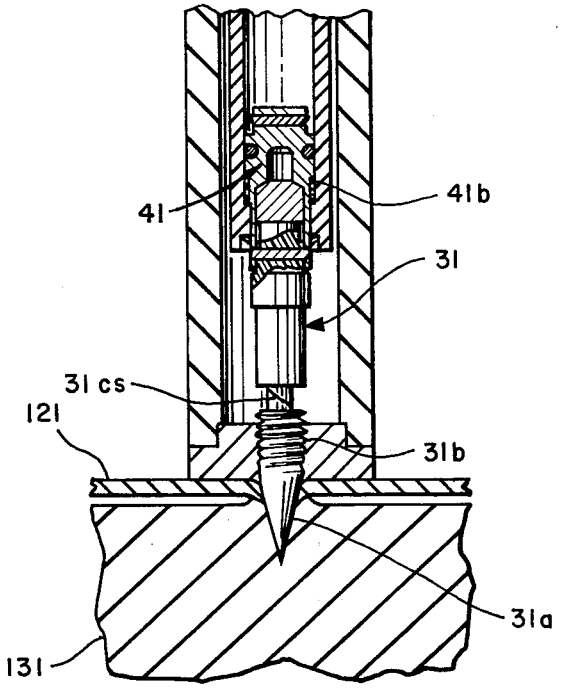
Figure 6:
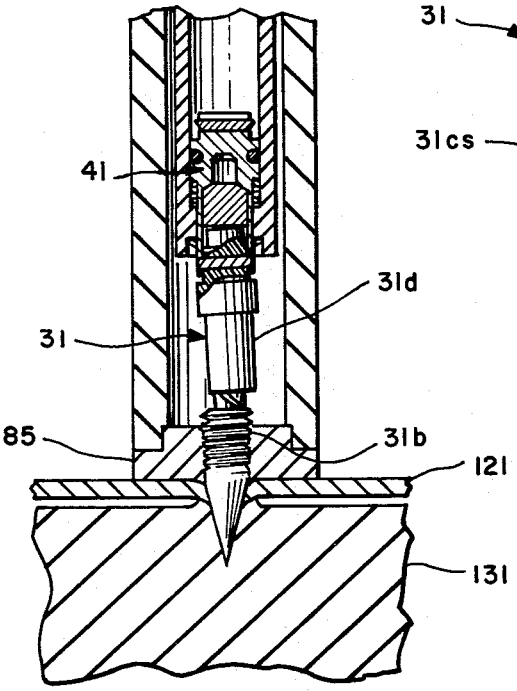
Figure 5A:
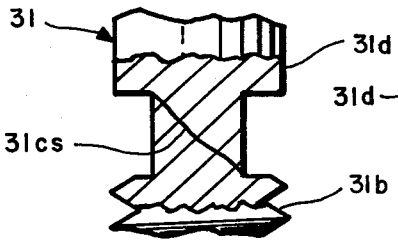
Figure 6A:
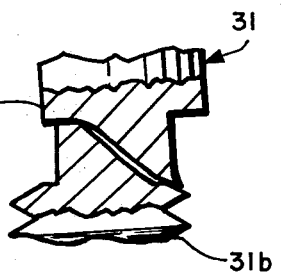

FIGS. 5*a* and 6*a* are enlarged views in partial section of the medial shear section of the nail during operation of the arrangement, and corresponding to the shear rupture and secondary self-impacting conditions illustrated respectively in FIGS. 5 and 6.

Referring now in detail to the Figures in the drawings, a nail cartridge arrangement according to the invention is generally indicated by the reference numeral 11, and includes a cartridge barrel 13 having a frangible seal 15, and within the bore 13*a* of which is disposed a nail or impact penetrating connector stud generally indicated at 31, which in turn is secured as by a retaining pin 39 to a pusher piston generally indicated at 41. Pusher piston 41 is in turn connected through a shear pin 49 to a propellant cup base 51 which is threadedly secured in the rear end of barrel 13, and which houses a percussion primer 53 and charge of ignitable propellant mix 55.

The cartridge 11 is removably secured within the bore 81*a* of a hand-held holder 81 which is closed at one end by closure member 85, formed of material such as steel, or other material suitable to enable member 85 to serve as a jam washer or nut portion of a threaded unit connection with the nail or stud 31. Closure 85 is press-fit into the lower open end of holder 81, and may be removed in the course of firing and securing of the nail or stud to a target sheet or thereafter by simply rocking the holder 81 after target securement. To this end, the closure 85 has a central recess 85*b* on its interior face, which recess is preferably of sufficient cross section to accommodate passage of the smooth pointed penetrator section 31*a* of the nail or stud 31 and of less diameter than the outer thread diameter of a threaded securing section 31*b* rearward of the tapered point 31*a*. A puncturable closure membrane 85*a* is formed across the bottom of the recess 85*b*, and is punctured by the nail or stud 31 in the course of firing the cartridge 11, the walls of recess 85*a* then engaging with threaded securing section 31*b*.

Securing of the cartridge 11 within the holder 81 is suitably effected by set screws 91 which engage with the exterior of the cartridge 11 rearwardly of a damping and center ring 16. A guard 87, with O-ring seals 89, may be secured over the area of set screws 91, through the medium of a set screw 93, thereby affording a substantially water-tight seal at this point between the bore 81*a* of the holder 81 and the exterior of the holder, and enabling the device to be more advantageously used underwater if so desired.

Figure 1:
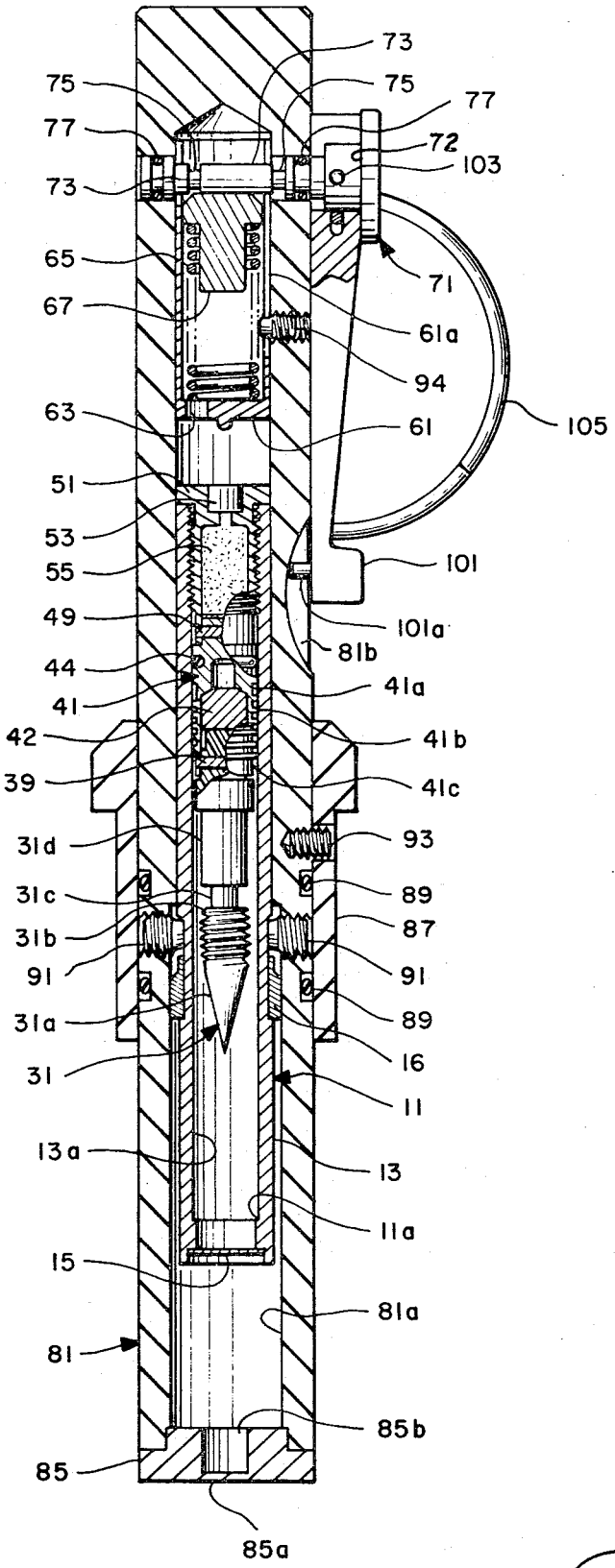
FIG. 1 is a longitudinal section view of a nailing arrangement embodying the invention.
Figure 2:
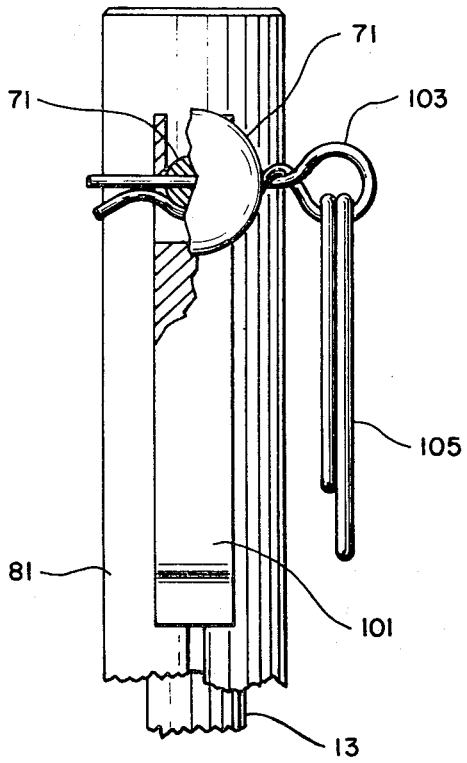
FIG. 2 is a fragmentary side view of the upper section of the arrangement of FIG. 1, taken as viewed from the righthand side of FIG. 1.

Disposed rearwardly of the cartridge 11 in the bore 81*a* is a firing pin which is held in the cocked position, as shown in FIG. 1, against the action of compression spring 65, through the medium of a retention/release pin 71. The retention/release pin 71 is held in the retention position by a safety handle 101 which longitudinally slidably engages therewith from the lower side, the safety handle 101 having a bifurcated end which extends between the enlarged head of the pin 71 and the exterior body of holder 81 to prevent movement of the pin toward the holder 81 until removal of the holder is effected preparatory to firing. A safety pin 103 extends through lateral holes in pin 71 and holder 81, and may be selectively removed by exerting a pulling force thereon with a pull ring 105, after which the safety handle may be slid downwardly along the holder 81 for removal. In the normal safety position, the safety handle is prevented from being angularly moved about the axis of pin 71, through engagement of a pin 101*a* on the safety handle with a guide slot 81*b* on the outer surface of the holder 81.

Figure 3:
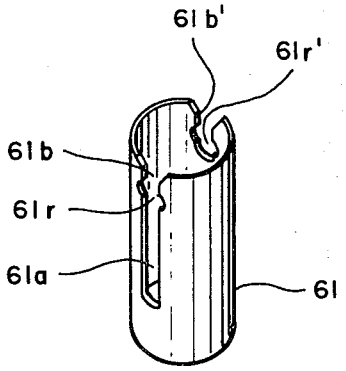
FIG. 3 is an enlarged view in perspective of the firing pin in the arrangement of FIG. 1.

The actuator retention/release pin 71 retains the firing pin 61 in the cocked position by engagement of retention sections 73 thereof with enlarged release holes 61*r*, 61*r'*; formed in the opposite walls of cup-shaped firing pin 61, these retention holes being best seen in FIG. 3, and the retaining relationship being illustrated in FIG. 1. Immediately adjacent the retention sections 71 of pin 71 are reduced neck release sections 75, which are of sufficiently small diameter to pass freely through release slot sections 61*b*, 61*b'* formed in the upper end of the cup-shaped firing pin 61, to thereby enable the firing pin to move downwardly upon the movement of the release pin 71 to the left by a small incremental extent after removal of the safety handle 101. The reduced neck release sections 75 are caused to be in registry with the release slots 61*b*, 61*b'* by engagement of the underside of the flanged head of release pin 71, which forms a shoulder stop 72 on the release pin 71 with the exterior surface of holder 81 when the pin 71 is moved to the left, as viewed in FIG. 1. O-rings 77 may be employed adjacent the internally opposite ends of pin 71 to afford water-tight sealing of the interior bore 81*a* of holder 81.

Upon registry of the reduced neck release sections 75 of pin 71 with the enlarged retention holes 61*r*, 61*r'*, the firing pin will move forward under the influence of the compression spring 65, being guided in this respect by a set screw guide pin 94 which slidably engages with guide slot 61*a* formed as a lower extension of release slot 61*b* and enlarged retention hole 61*r* in the firing pin 61. The firing pin 61 may have one or more fluid bypass orifices 61 formed in its forward end to enable fluid pressure equilization, and thereby enable full utilization of the firing pin force exerted by compression spring 65.

Upon impacting of the firing pin 61 with the primer 53 the propellant mix 55 will be ignited to effect shearing of the shear pin 49 and movement of the pusher piston 41 and nail or stud 31 downward as viewed in FIG. 1, it being appreciated that the refernce to direction as being downward is only with respect to the Figure and does not indicate that the device will or must be fired in any given position. The device is capable of operating in any orientation relative to a given target to which it is desired to secure the nail or stud 31 and closure nut member 85.

Pusher piston 41 has formed on its outer annular surface a series of sealing and shear stop rings 41*b* which are separated by annular grooves 41*a*, these rings and grooves serving the dual purpose of aiding in sealing the propellant gases and also enabling final energy absorbing stopping and retention of the pusher piston 41 within the forward end of cartridge 11. To this end, there is formed at the forward end of bore 13*a* in cartridge barrel 13 a shoulder stop 11*a* which enables the free passage therepast of the nail or stud 31, while engaging the shear stop rings 41*b*, thereby causing the rings 41*b* to be sheared as the pusher piston 41 attempts to move therepast, the number of rings being sufficient to absorb the remaining energy in the pusher piston 41 after nail or stud 31 is secured to the target, and to retain the pusher piston within the cartridge barrel 13 at the end of the firing sequence.

As noted heretofore, the nail or stud 31 is formed with a penetrator section 31*a* which takes the preferred form of a smooth tapered securing point 31*a*, rearwardly of which is a threaded securing section 31*b* which is of substantially constant thread diameter along its length, to thereby simulate a threaded stud end when the nail or stud 31 is embedded in a target sheet, with the threaded securing section 31*b* protruding on the exterior of the target. The nail or stud 31 is formed as an integral unit with a rear hammer section 31*d* connecting with the forward penetrator section 31*a* and threaded securing section 31*b* through a reduced diameter shear section 31*c*. A plug 42 may be employed, if desired, rearwardly of hammer section 31*d* to absorb shock and forward motion force between the hammer section 31*d* and pusher piston 41.

The reduced diameter shear section 31*c* is formed with a sufficient diameter to provide the necessary column strength between the penetrator and threaded nut or washer-securing sections 31*a*, 31*b* on the one hand and the hammer section 31*d* on the other hand, to insure that the necessary precise force is imparted from the pusher piston 41 to the penetrator section 31*a* to afford desired penetration of the penetrator section 31*a* into a target sheet. With a high tensile target (eg 100,000 psi ultimate tensile strength), a desired and proper extent of penetration by a point having a length of 0.45 inch and a rear diameter of 0.230 inch, has been found to be approximately 0.35 inch. To effect this extent of penetration, using a one-piece high-strength steel (eg maraging steel 300) nail or stud 31, a diameter of approximately 0.150 inch for the frangible section has been found satisfactory, with a 0.280-inch diameter hammer section 31*d* and threaded securing section 31*b* thereadjacent. After the proper depth of penetration of point 31*a* has been effected during initial impact, increased resistance by the target to further point penetration causes the frangible reduced diameter shear section 31*c* to fail in compression shear, and the hammer section 31*d* will continue forward to impart a further secondary impact to the rear of the integral point and threaded securing sections 31*a*, 31*d*, as illustrated in FIGS. 5 and 6 respectively, as well as enlarged FIGS. 5*a* and 6*a*, the shear rupture zone being indicated schematically at 31*cs*, FIGS. 5 and 5*a* being schematically illustrative of the secondary impacting effected as a result thereof, by the hammer section 31*d*.

Figure 4:
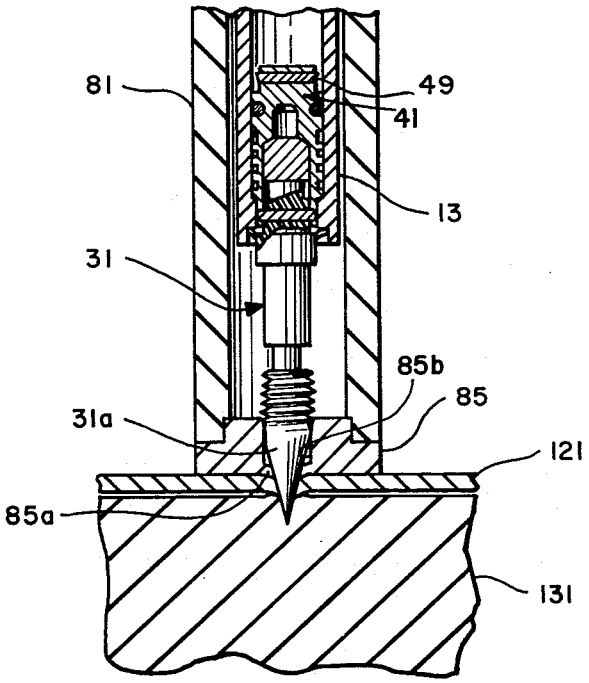
FIGS. 4, 5 and 6 are schematic section views illustrating sequential steps in the operation of the arrangement of FIG. 1 in securing the nail or stud according to the invention, to a target plate.

As will be seen from FIGS. 4–6, the penetrator section 31*a* of nail or stud 31 passes through closure member 85*a* and the object, such as a metal sheet 121, which is to be attached to a target plate 131, causing lateral displacement of each of the closure membrane 85*a*, the metal object sheet 121 and the metal target plate 131, an effective degree of penetration being illustrated in FIGS. 5 and 6, at which point the threaded section 31*b* is in radial jam engagement with the walls of closure member recess 85*b*, and the smooth tapered point section 31*a* is engaging with the metal sheet 121 and the target plate 131. At this position, the resistive forces of the target plate 131 are sufficient to overcome the column strength of the shear section 31*c*, thereby effecting the shear rupture as indicated at 31*cs*. The remaining kinetic energy of the pusher piston 41 and the hammer section 31*d* will thereupon cause the hammer 31*d* to effect a secondary impact on the rear end of the penetrator and threaded securing sections 31*a*, 31*b*, to thereby prevent the penetrator points sections 31*a* from bouncing out of its penetration contact with the target 131, and also affords a further securing action at the point of contact with the point section 31*a* and the target 131. The thus embedded point is effectively secured with the target plate, being frictionally secured and apparently to some extent welded to the target material. It has been found that with an arrangement of this nature the nail may be effectively secured to withstand an axial pull of approximately 6,000 pounds, and such has been successfully used as a fastener to mild steel, 4130 steel, HY80 steel, and HY100 steel, in thickness ranging from ⅜ inch to effectively infinite thickness.

While the invention has been described with respect to a single preferred embodiment, it will be apparent that various modifications and improvements will be made without departing from the scope and spirit of the invention. For instance, while in the illustrative embodiment there is disclosed a particular means for actuating the latent energy means, it is not necessary that such be a part of the manufactured apparatus, nor that such be sold or furnished to a user with such an actuating means. The actuating means could be added or supplied later at time of use, or actuation could be accomplished manually. Additionally, various separate auxiliary apparatus, both mechanical and electrical, for firing or otherwise actuating primers, propellants charges, etc., or other latent energy means, are well known, as in the ordnance art, and are not necessary to be described for an understanding of this invention as to scope or manner of alternative practice thereof by one skilled in the art. Further, while a specific illustrative embodiment has been illustrated and described, and has been found to be desirable and workable embodiment, and while various detailed features of such embodiment may themselves be additionally novel and unobvious, the broad invention of my double impact nailing arrangement impact-compression shearable double impact nail unit, either as a total arrangement or as a novel and an unobvious subcombination useful for nailing, either clearly does not require the particular structural arrangement of the illustrative embodiment such as the sealed barrel 13, hand-held holder 81, cartridge 11, pusher 41, primer-ignited propellant powder latent energy means 55, safety firing pin arrangment 63, 73, 75, 101, 105, or energy-absorbing shear ring arrangement 41*a*, 11*a*.

Also, the position or precise form of the various parts in a given particular embodiment is not critical for practice of the broad aspect of the invention as claimed. For example, referring to the particular illustrative embodiment, while the igniting means does occupy a position within the support means formed by cartridge 11 and barrel 13 in the illustrative arrangement of FIG. 1 as it is vertically disposed, it not only need not be above the latent energy means when the portable arrangement of FIG. 1 is moved to a different position, but neither it nor the latent energy means need be within the support means, as various and sundry other arrangements may be provided, including arrangements where the igniting means or both the igniting means and propellant charge latent energy means is external of and/or has no specific relation to the support means. Accordingly, the invention is not to be limited by the illustrative embodiment, but only by the scope of the apended claims.

I claim:

1. An impact nailing arrangement, comprising support means, a nail unit carried and directionally oriented by said support means, and latent energy means disposed in energy-transmitting relation to said nail unit for imparting linear motion to said nail unit, said nail unit having a forward penetrator section, a hammer section and a medial impact-compression shear section between said penetrator section and said hammer section, and which impact-compression shear section is impact-shearable as a function of energizing said latent energy means and resultant linear motion impacting of said penetrator section with a target object to which it is desired to be attached.

2. An impact nailing arrangement according to claim 1, said hammer section, medial shear section and forward penetrator sections being integral prior to shear rupture of said shear section.

3. An impact nailing arrangement according to claim 2, said medial shear section having a reduced cross section relative to said hammer section and the adjacent rearward zone of said forward penetrator section.

4. An impact nailing arrangement according to claim 3, said penetrator section having a forward point end and a threaded securing portion rearwardly of its forward point end.

5. An impact nailing arrangment according to claim 3, said penetrator section having a longitudinally smooth forward penetrating end and a non-smooth securing portion rearwardly of its forward end.

6. An impact nailing arrangement according to claim 2, said penetrator section having a longitudinally smooth tapered point end and a threaded securing portion rearwardly of its forward end.

7. An impact nailing arrangement according to claim 2, said penetrator section having a longitudinally smooth forward penetrating end and non-smooth securing portion rearwardly of its forward end.

8. An impact nailing arrangement according to claim 1, said medial shear section having a reduced cross section relative to said hammer section and the adjacent rearward zone of said forward penetrator section.

9. An impact nailing arrangement according to claim 1, said penetrator section having a threaded securing portion rearwardly of its forward end.

10. An impact nailing arrangement according to claim 1, said penetrator section having a non-smooth securing portion rearwardly of its forward end.

11. An impact nailing arrangement according to claim 1, said support means comprising a barrel having a bore formed therein, said bore forming guide means for longitudinal motion-guiding of said nail unit.

12. An impact nailing arrangement according to claim 11, said latent energy means for imparting linear motion to said nail unit comprising a propellant charge, said impact nailing arrangement further comprising means for igniting aaid propellant charge.

13. An impact nailing arrangement according to claim 1, said latent energy means for imparting linear motion to said nail unit comprising a propellent charge, said impact nailing arrangement further comprising means for igniting said propellant charge.

* * * * *